US009613614B2

(12) United States Patent
Huang

(10) Patent No.: US 9,613,614 B2
(45) Date of Patent: Apr. 4, 2017

(54) NOISE-REDUCING HEADPHONE

(71) Applicant: Jetvox Acoustic Corp., Taoyuan (TW)

(72) Inventor: To-Teng Huang, Taoyuan (TW)

(73) Assignee: Jetvox Acoustic Corp., Taoyuna (TW)

( * ) Notice: Subject to any disclaimer, the term of this patent is extended or adjusted under 35 U.S.C. 154(b) by 11 days.

(21) Appl. No.: 14/725,413

(22) Filed: May 29, 2015

(65) Prior Publication Data

US 2016/0210956 A1 Jul. 21, 2016

(30) Foreign Application Priority Data

Jan. 16, 2015 (TW) ..... 104200800 U

(51) Int. Cl.
*G10K 11/16* (2006.01)
*G10K 11/178* (2006.01)

(52) U.S. Cl.
CPC .. *G10K 11/1782* (2013.01); *G10K 2210/1081* (2013.01)

(58) Field of Classification Search
CPC ..... G10K 11/1782; G10K 2210/1081
See application file for complete search history.

(56) References Cited

U.S. PATENT DOCUMENTS 5,909,498 A * 6/1999 Smith ..... H04R 1/1016 381/375
7,466,838 B1 * 12/2008 Moseley ..... G10K 11/1788 381/370
2010/0046783 A1 * 2/2010 Huang ..... H04R 1/1075 381/380
2011/0286607 A1 * 11/2011 Kimura ..... G10K 11/1788 381/71.6
2014/0169583 A1 * 6/2014 Huang ..... H04R 1/24 381/74
2015/0373460 A1 * 12/2015 Huang ..... H04R 1/02 381/190

* cited by examiner

*Primary Examiner* — Regina N Holder
(74) *Attorney, Agent, or Firm* — Muncy, Geissler, Olds & Lowe, P.C.

(57) ABSTRACT

A noise-reducing headphone includes a headphone housing, a speaker unit, and a microphone. The headphone housing includes an accommodating space and a sound output hole. The accommodating space is communicated with the sound output hole. The speaker unit is positioned in the accommodating space. The speaker unit includes a speaker unit housing and a diaphragm disposed on the speaker unit housing. The diaphragm faces toward the sound output hole and includes a central through hole and an annular vibrating portion around the central through hole. The diaphragm produces sound waves toward the sound output hole by vibrations of the annular vibrating portion. The microphone is disposed on the speaker unit housing and is positioned in the central through hole. The microphone is coaxial to the central through hole. One face of the microphone faces toward the sound output hole and the other faces toward the inner of the headphone housing.

10 Claims, 6 Drawing Sheets

NOISE-REDUCING HEADPHONE

CROSS-REFERENCES TO RELATED APPLICATIONS

This non-provisional application claims priority under 35 U.S.C. §119(a) on Patent Application No. 104200800 filed in Taiwan, R.O.C. on Jan. 16, 2015, the entire contents of which are hereby incorporated by reference.

BACKGROUND

Technical Field

The instant disclosure relates to a headphone, and more particularly, to a noise-reducing headphone.

Related Art

Headphones are used to transfer sounds in communication, teaching, and music listening. Headphones have variant structures and types such as full size headphones, in-ear headphones, or earphones. Although general in-ear headphones or full size headphones are capable of reducing noise about 15 db to 25 db, it is not enough if environment noise is loud. When using these headphones, users are hardly hearing sounds of movies or music reproduced by the headphones because of the affections of loud environment noise. A kind of noise-canceling headphones can cancel noise in a manner of destructive interference to neutralize outside noise. A microphone in the noise-canceling headphones is utilized for sensing sound waves of noise transferred from outside into a housing of the headphones. And speakers in the headphones are utilized for accordingly produce pressure waves to neutralize noise. Consequently, users using the noise-canceling headphones have no need to increase the sound volume of the headphones even in the circumstance that environment noise is loud.

By the anti noise control (ANC) means, the noise-canceling headphones can now cancel unpleasant noise coming from outside environment. The noise-canceling headphones include electronic devices and speakers to perform active neutralizing process. The electronic devices include at least one microphone disposed close to the ear of users for receiving outside noise, and an electronic circuit capable of accordingly generating signals of which the phases are inverted relating to the phases of noise. The generated inverted signals can destructively interfere and neutralize outside noise that enter users' ears in the first place.

Noise-canceling headphones available on the markets include a speaker unit, a protective cover, and a microphone hung below the speaker unit or disposed on a periphery of the protective cover of the headphones such that the microphone cannot receive sounds evenly distributed around the speaker unit. As a result, the electronic circuit generates inverted signals merely according to sounds received from a partial area of a periphery of the speaker unit. To improve relative structures of the headphones is therefore desirous.

SUMMARY

To address the above issue, the instant disclosure provides a noise-reducing headphone comprising a headphone housing, a speaker unit, and a microphone. The headphone housing comprises an accommodating space and a sound output hole. The accommodating space is communicated with the sound output hole. The speaker unit is positioned in the accommodating space. The speaker unit comprises a speaker unit housing and a diaphragm disposed on the speaker unit housing. The diaphragm faces toward the sound output hole and comprises a central through hole and an annular vibrating portion around the central through hole. The diaphragm produces sound waves toward the sound output hole by vibrations of the annular vibrating portion. The microphone is disposed on the speaker unit housing and is positioned in the central through hole. The microphone is coaxial to the central through hole. One face of the microphone faces toward the sound output hole. The other face of the microphone faces toward the inner of the headphone housing.

According to an embodiment, one face of the microphone and one face of the speaker unit are in a same plane.

According to an embodiment, the headphone housing comprises a body, a speaker mount covering the body, and an ear pad covering the speaker mount. The accommodating space is formed in the body. The sound output hole is disposed in the centre of the speaker mount.

According to an embodiment, the speaker unit housing comprises a case and a protective net. The protective net covers the diaphragm so that the diaphragm is against the case.

According to an embodiment, the protective net comprises a coupling hole corresponding to the central through hole. The microphone is disposed in the coupling hole.

According to an embodiment, a gap for air flowing is formed between the coupling hole and the microphone.

According to an embodiment, the protective net comprises a plurality of through holes corresponding to a periphery of the diaphragm.

According to an embodiment, the speaker unit further comprises a washer, an annular magnet, and an outer yoke. The annular magnet is positioned in the outer yoke. The washer is positioned on a surface of the annular magnet.

According to an embodiment, the speaker unit further comprises a voice coil assembled to the diaphragm. The voice coil surrounds and is coupled to the washer.

According to an embodiment, the speaker unit further comprises a circuit board disposed in the accommodating space and electrically connected to the outer yoke.

Some embodiments have a configuration that the microphone for receiving sounds is disposed in the centre of the speaker unit and is coaxial to the speaker unit. The microphone is therefore capable of receiving noise evenly distributed around the speaker unit. The issue that the electronic circuit generates inverted signals merely according to sounds received from a partial area of a periphery of the speaker unit can be avoided. In addition, a gap formed between the coupling hole and the microphone allows rear sound waves coming from the back of the diaphragm of the speaker unit to pass through, which is of benefit to the reaction of the movement of the diaphragm and to the adjustment of the strength of low-frequency sound waves so that sounds produced by the headphone can meet the requisite frequency ranges and sound qualities.

The features of the instant disclosure will no doubt become understandable to those of ordinary skill in the art after reading the following detailed description of the preferred embodiment that is illustrated in the various figures and drawings.

DETAILED DESCRIPTION

Figure 1:
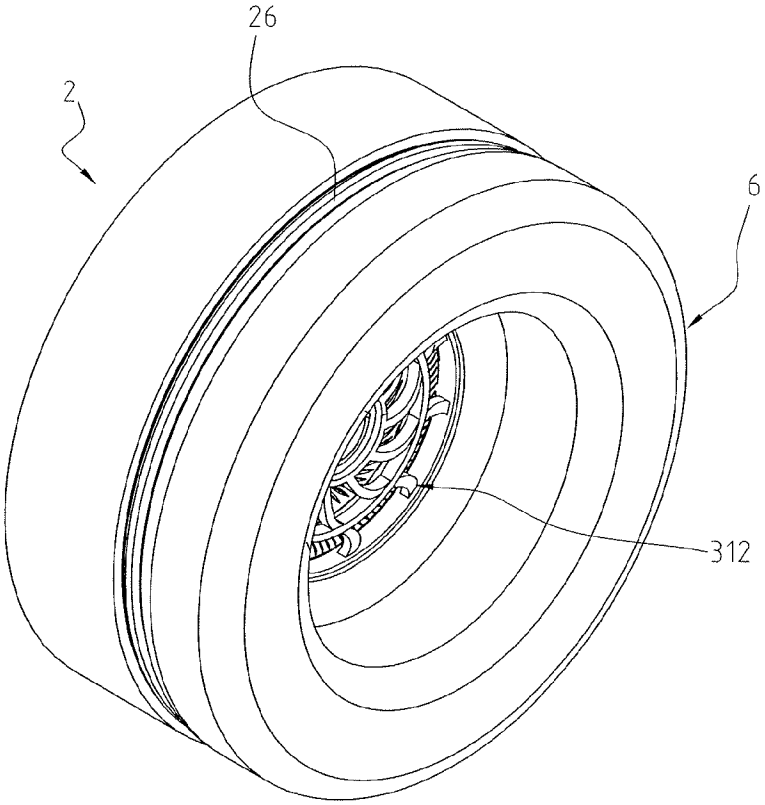
FIG. 1 illustrates a perspective view of a noise-reducing headphone according to an embodiment of the instant disclosure.
Figure 2:
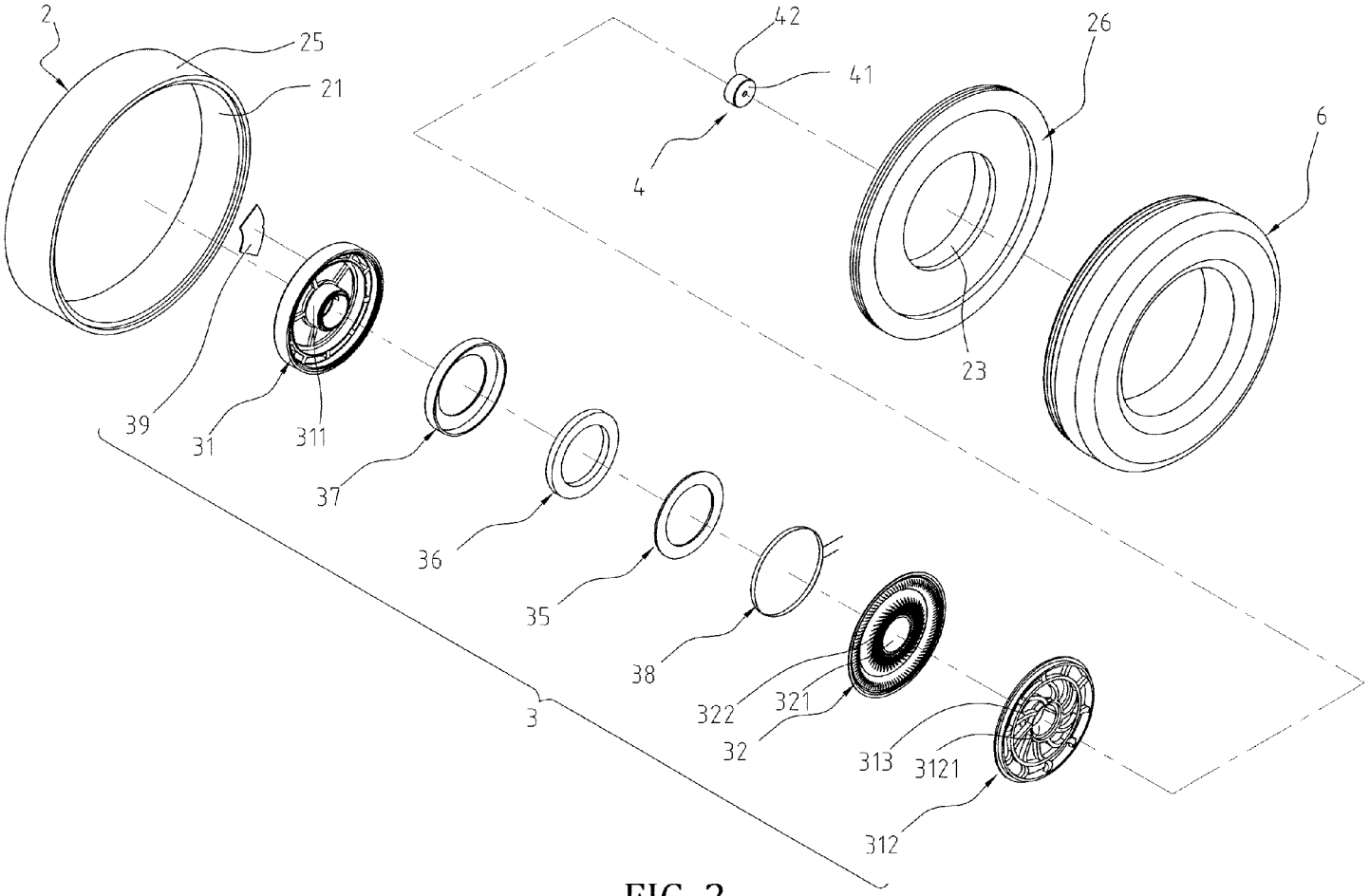
FIG. 2 illustrates an exploded view of the noise-reducing headphone according to the embodiment of the instant disclosure.
Figure 3:
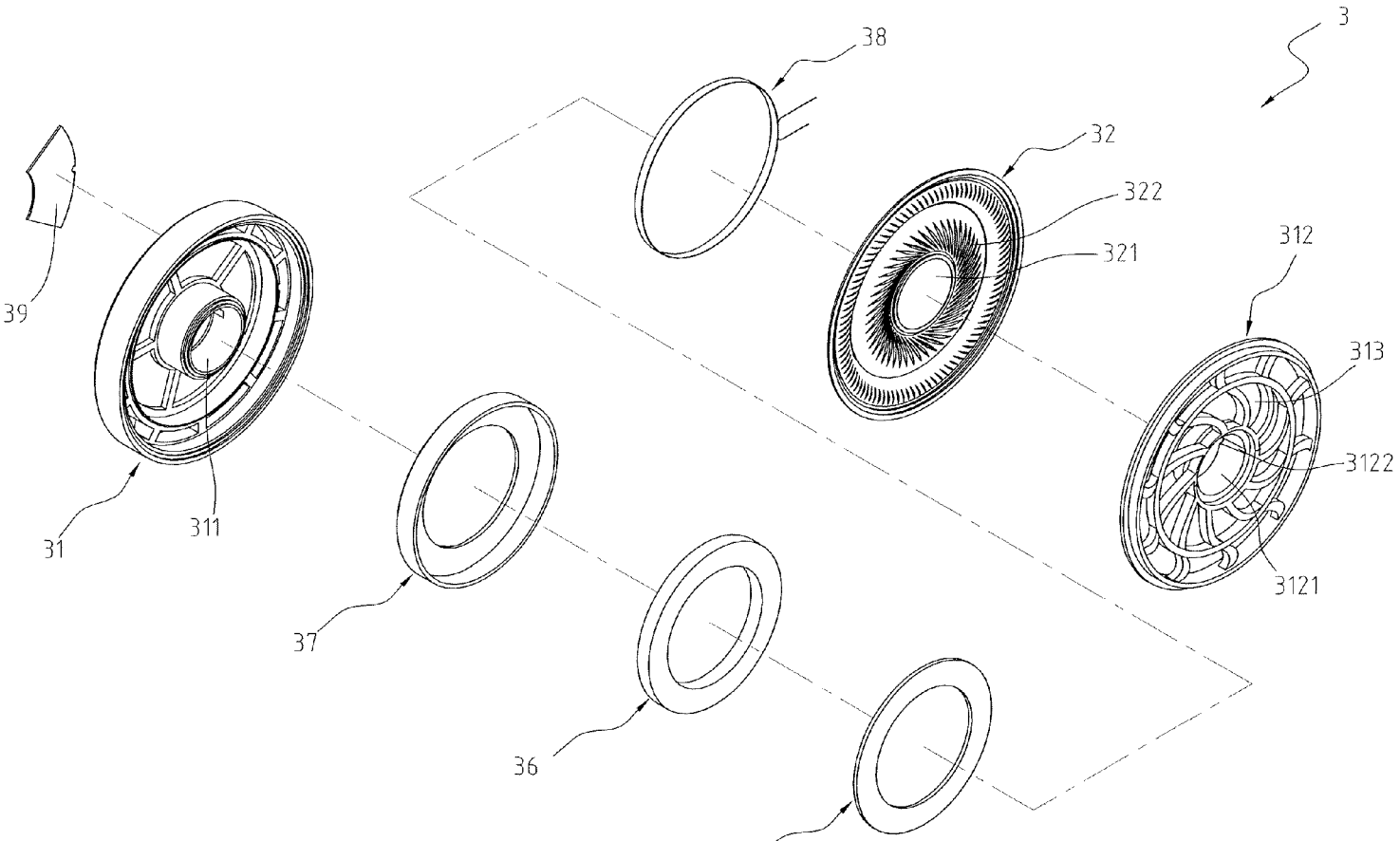
FIG. 3 illustrates an exploded view of a speaker unit according to the embodiment of the instant disclosure.

FIG. 1, FIG. 2 and FIG. 3 illustrate a first embodiment of the instant disclosure. FIG. 1 is a perspective view of a noise-reducing headphone. FIG. 2 is an exploded view of the noise-reducing headphone. FIG. 3 is an exploded view of a speaker unit. Referring to FIG. 1 and FIG. 2, the noise-reducing headphone 1 can cancel unpleasant noise coming from environment in a manner of active noise control (ANC) system. The noise-reducing headphone 1 includes a headphone housing 2, a speaker unit 3, and a microphone 4. For illustration, the diameter of the headphone 1 is, but is not limited to, 50 mm. In other embodiments of the instant disclosure, the diameter of the headphone 1 can be varied. For example, the diameter can be 40 mm or 60 mm.

Figure 4:
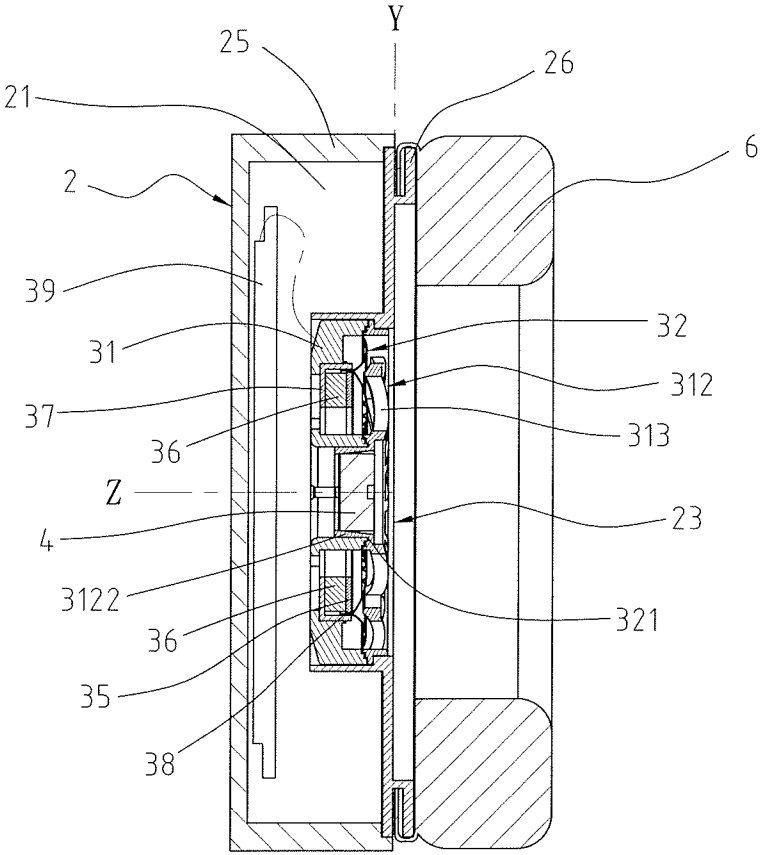
FIG. 4 illustrates a side view of the noise-reducing headphone according to the embodiment of the instant disclosure.

Referring to FIG. 2, FIG. 3 and FIG. 4, the headphone housing 2 is composed of plural components. In other embodiment, the headphone housing 2 can be a one-piece component. The speaker unit 3 and the microphone 4 are modularized to be assembled to each other into a single component for being easily connected to the headphone housing 2. In the embodiment, the headphone housing 2 is composed of plural components including a body 25 and speaker mount 26. The body 25 has a shape of a case having an opening aside. The speaker mount 26 covers the body 25. The headphone housing 2 includes an accommodating space 21 and a sound output hole 23 being communicated with each other. The accommodating space 21 is formed in the body 25. The sound output hole 23 is disposed in the centre of the speaker mount 26. In the phase that the speaker mount 26, the body 25, and other components are assembled together, the front sound output hole 23 and the rear accommodating space 21 (rear cavity) are separated and isolated by other components. In addition, the headphone housing 2 further includes an ear pad 6. The ear pad 6 covers a periphery of the speaker mount 26, which can be configured to full size headphones or supra-aural headphones.

Referring to FIG. 2, FIG. 3 and FIG. 4, the speaker unit 3 is positioned in the accommodating space 21 (i.e., the speaker unit 3 is mounted in the sound output hole 23 of the speaker mount 26). The speaker unit 3 includes a speaker unit housing 31 and a diaphragm 32. The speaker unit housing 31 is composed of a case 311 and a protective net 312. The case 311 is made by aluminum and has an opening aside. The case 311 includes plural holes formed on the bottom away from the opening for allowing the passage of lines. The protective net 312 is a cover structure having an annular shape. The protective net 312 is connected to the case 311 and covers the opening of the case 311. The periphery of the protective net 312 covers the periphery of the diaphragm 32 so that the diaphragm 32 is against and fastened to the case 311. In addition, the protective net 312 includes a coupling hole 3121. The microphone 4 is disposed in the coupling hole 3121. The protective net 312 includes plural through holes 313 corresponding to the periphery of the diaphragm 32 and allowing sound waves to pass through.

Figure 5:
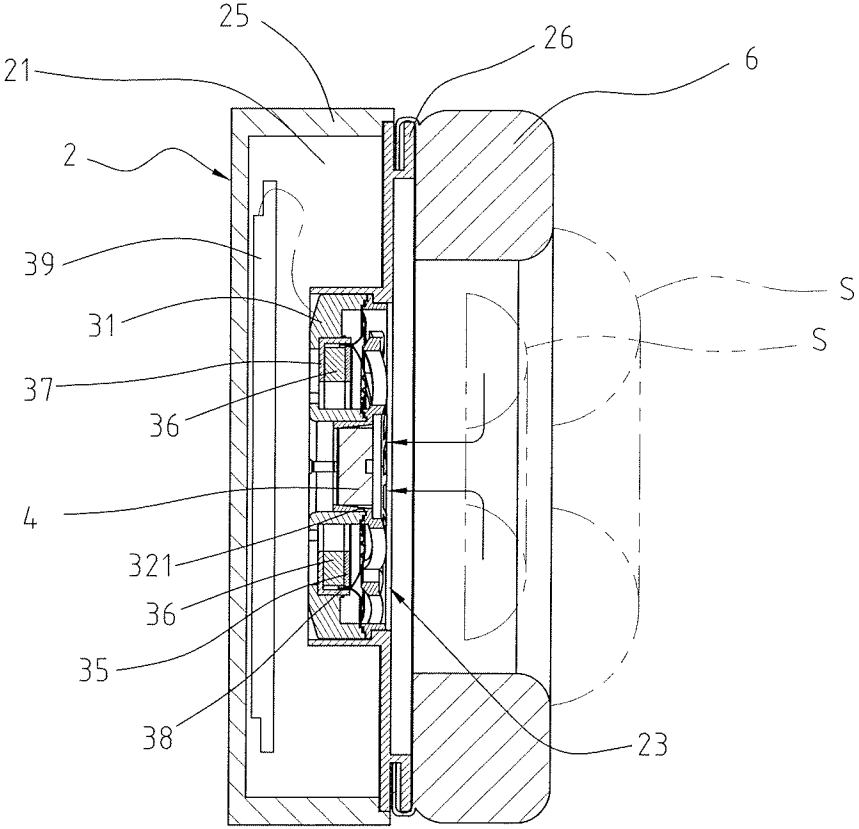
FIG. 5 illustrates a side view of a diaphragm with diagrammatic sound waves and a microphone receiving noise of the instant disclosure.
Figure 6:
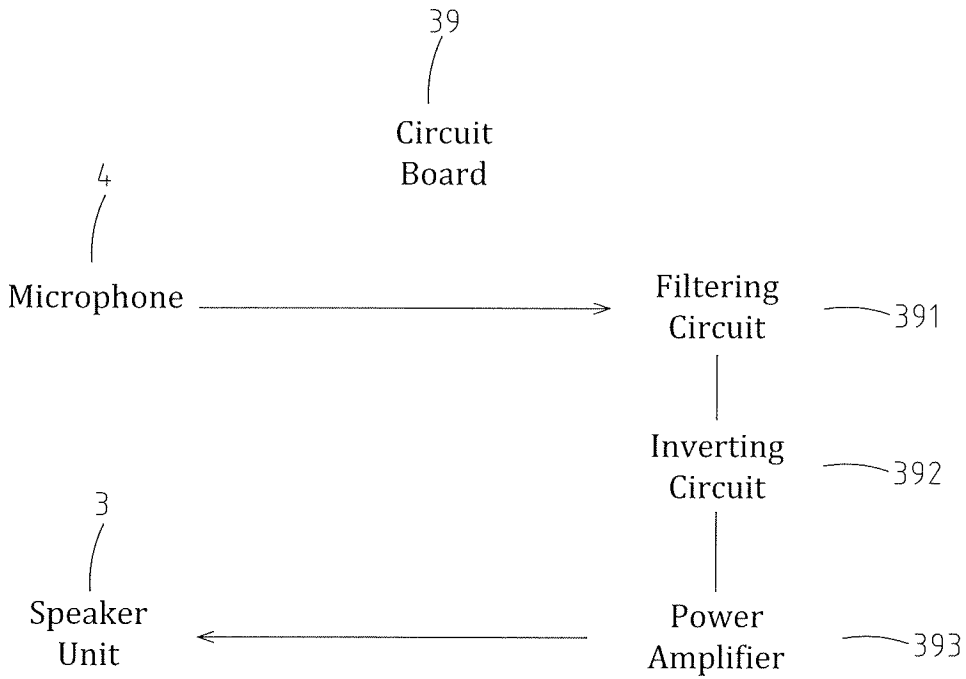
FIG. 6 illustrates a block diagram of a circuit structure according to the embodiment of the instant disclosure.

Referring to FIG. 2, FIG. 4, and FIG. 5, the diaphragm 32 has an annular shape. The diaphragm 32 is disposed on the speaker unit housing 31, and faces toward the sound output hole 23. The diaphragm 32 includes a central through hole 321 and an annular vibrating portion 322 around the central through hole 321. The coupling hole 3121 of the protective net 312 is corresponding to and can be coaxial to the central through hole 321. The diaphragm 32 produces sound waves S toward the sound output hole 23 by vibrations of the annular vibrating portion 322. The sound waves S are outputted from the annular vibrating portion 322 and spread outwardly in an annular form. A central area of the annular sound waves S is the area that no sound waves are produced. During the vibration of the annular vibrating portion 322, front sound waves S and rear sound waves S are accordingly produced and outputted. The front sound waves S are outputted in a direction toward the sound output hole 23. The rear sound waves S are outputted in a direction away from the sound output hole 23 (i.e., toward the inner of the headphone housing 2). Sound waves S produced by the vibration of the annular vibrating portion 322 include low-frequency range and high-frequency ranges.

Referring to FIG. 2, FIG. 4 and FIG. 5, the microphone 4 is disposed on the speaker unit housing 31 and is positioned in the central through hole 321. The microphone 4 faces toward the sound output hole 23. The central axis of the microphone 4, which is the same as the Z axis shown in FIG. 4, is coaxial to that of the central through hole 321. The central axis of the microphone 4 is also coaxial to that of the sound output hole 23 of the headphone housing 2. One face 41 of the microphone 4 and one face of speaker unit 3 are in a same plane, which vertically passes the Y axis shown in FIG. 4. Namely, one face of the microphone 4 is aligned with the surface of the protective net 312. Either one face 41 of the microphone 4 receives sound waves (e.g., environment noise) from the sound output hole 23 (i.e., from an area close to the ear of a user of the headphone 1), or the other face 42 of the microphone 4 receives sound waves (e.g., environment noise) from the inner of the headphone housing 2 (i.e., from the accommodating space 21). In other embodiment, both of the faces 41, 42 of the microphone 4 receive sound waves respectively from the sound output hole 23 and the inner of the headphone housing 2.

Referring to FIG. 2, FIG. 4, FIG. 5, and FIG. 6, the speaker unit 3 includes a circuit board 39. The circuit board 39 is connected to the microphone 4. The circuit board 39 includes a filtering circuit 391, an inverting circuit 392, and a power amplifier 393. The microphone 4 receives sound waves and transfers signals converted from the sound waves to the filtering circuit 391. The filtering circuit 391 filters the signals in a manner of, for example, notch filtering, low pass filtering, or high pass filtering. The inverting circuit 392 receives and inverts the filtered signals from the filtering circuit 391. The power amplifier 393 receives and amplifies the inverted signals from the inverting circuit 392. The speaker unit 3 receives and outputs the amplified signals from the power amplifier 393. Specifically, the microphone 4 is coaxial to the speaker unit 3, and the microphone 4 is utilized for receiving sound waves (e.g., outside noise) around the speaker unit 3 and then generates environment signals. The environment signals are transferred to the filtering circuit 391 and are processed by the filtering circuit 391. The filtering circuit 391 accordingly generates filtered signals. The filtered signals are transferred to the inverting circuit 392. The inverting circuit 392 inverts the filtered signals into inverted signals. The inverted signals are transferred to the power amplifier 393. The power amplifier 393 amplifies the inverted signals into noise-reducing signals, and the noise-reducing signals are transferred to a voice coil 38 of the speaker unit 3. The generation of the noise-reducing signals accords to the inverted, filtered, and amplified environment signals. The noise-reducing signals can be superposed onto original signals inputted to the headphone 1 and outputted by the speaker unit 3, such as music signals, into superposition signals. The noise-reducing signals mixed in the superposition signals can neutralize environment noise so that users using the headphone 1 can hear pure music without disturbance of noise.

Referring to FIG. 2, FIG. 4, and FIG. 5, after the microphone 4 is mounted to the coupling hole 3121 of the protective net 312, a gap 3122 for air flowing is formed between the coupling hole 3121 and the microphone 4. The centre of the annular sound waves S is an area in which no sound waves are produced. The air can flow through the gap 3122 between the coupling hole 3121 and the microphone 4, and flow into the central through hole 321. If the space in the headphone housing 2 is entirely sealed, the sound waves S flowing into the space cannot disperse so that the operation of the speaker unit 3 may have negative effect. The gap 3122 formed between the coupling hole 3121 and the microphone 4 allows rear sound waves S coming from the diaphragm 32 of the speaker unit 3 to pass through, which is of benefit to the reaction of the movement of the diaphragm 32 and to the adjustment of the strength of low-frequency sound waves so that sounds produced by the headphone 1 can meet the requisite frequency ranges and sound qualities. In some embodiments, after the microphone 4 is mounted to the coupling hole 3121 of the protective net 312, the microphone 4 seals the coupling hole 3121. In other words, there is no gap for air flowing between the coupling hole 3121 and the microphone 4.

Referring to FIG. 2, FIG. 4, and FIG. 5, the speaker unit 3 which is, for example, a moving coil drive unit further includes a washer 35, an annular magnet 36, an outer yoke 37, and the voice coil 38. The annular magnet 36 is positioned in the outer yoke 37. The washer 35 is positioned on a surface of the annular magnet 36. The voice coil 38 is assembled to the diaphragm 32. An inner side of the voice coil 38 surrounds and is coupled to the washer 35, and an outer side of the voice coil 38 is positioned on the outer yoke 37.

Referring to FIG. 2, FIG. 4, and FIG. 5, the circuit board 39 is disposed in the accommodating space 21. The circuit board 39 is connected to lines and is electrically connected to the outer yoke 37.

The instant disclosure has a configuration that the microphone for receiving sounds is disposed in the centre of the speaker unit and is coaxial to the speaker unit. The microphone is therefore capable of receiving noise evenly distributed around the speaker unit. The issue that the electronic circuit generates inverted signals merely according to sounds received from a partial area of a periphery of the speaker unit can be avoided. In addition, a gap formed between the coupling hole and the microphone allows rear sound waves coming from the back of the diaphragm of the speaker unit to pass through, which is of benefit to the reaction of the movement of the diaphragm and to the adjustment of the strength of low-frequency sound waves so that sound waves produced by the headphone can meet the requisite frequency ranges and sound qualities.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. A noise-reducing headphone, comprising:

a headphone housing comprising an accommodating space and a sound output hole, the accommodating space being communicated with the sound output hole;

a speaker unit disposed in the headphone housing and positioned in the accommodating space, the speaker unit comprising a speaker unit housing and a diaphragm disposed on the speaker unit housing, the diaphragm facing toward the sound output hole and comprising a central through hole and an annular vibrating portion around the central through hole, the diaphragm producing sound waves toward the sound output hole by vibrations of the annular vibrating portion; and a microphone disposed on the speaker unit housing and positioned in the central through hole, the microphone being coaxial to the central through hole, one face of the microphone facing toward the sound output hole, the other face of the microphone facing toward the inner of the headphone housing, wherein one face toward the sound output hole of the speaker unit and one face toward the sound output hole of the microphone are in a same plane.

2. The noise-reducing headphone of claim 1, wherein the headphone housing comprises a body, a speaker mount covering the body, and an ear pad covering the speaker mount, the accommodating space is formed in the body, and the sound output hole is disposed in the centre of the speaker mount.

3. The noise-reducing headphone of claim 1, wherein the speaker unit housing comprises a case and a protective net, and the protective net covers the diaphragm so that the diaphragm is against the case.

4. The noise-reducing headphone of claim 3, wherein the protective net comprises a coupling hole corresponding to the central through hole, and the microphone is disposed in the coupling hole.

5. The noise-reducing headphone of claim 4, wherein a gap for air flowing is formed between the coupling hole and the microphone.

6. The noise-reducing headphone of claim 3, wherein the protective net comprises a plurality of through holes corresponding to a periphery of the diaphragm.

7. The noise-reducing headphone of claim 1, wherein the speaker unit further comprises a washer, an annular magnet, and an outer yoke, the annular magnet is positioned in the outer yoke, and the washer is positioned on a surface of the annular magnet.

8. The noise-reducing headphone of claim 7, wherein the speaker unit further comprises a voice coil assembled to the diaphragm, and the voice coil surrounds and is coupled to the washer.

9. The noise-reducing headphone of claim 7, wherein the speaker unit further comprises a circuit board disposed in the accommodating space and electrically connected to the outer yoke.

10. The noise-reducing headphone of claim 9, wherein the circuit board is connected to the microphone and the circuit board comprises a filtering circuit, an inverting circuit, and a power amplifier connected to each other.

* * * * *